United States Patent [19]

Solomon

[11] Patent Number: 4,777,568

[45] Date of Patent: Oct. 11, 1988

[54] LOW-INERTIAL BEAM DIRECTION LIGHTING SYSTEM

[75] Inventor: Dennis Solomon, Yarmouth, Mass.

[73] Assignee: Altman Stage Lighting Co., Yonkers, N.Y.

[21] Appl. No.: 119,396

[22] Filed: Nov. 10, 1987

Related U.S. Application Data

[63] Continuation-in-part of Ser. No. 926,632, Nov. 3, 1986, Pat. No. 4,729,071.

[51] Int. Cl.[4] ..... F21V 21/30

[52] U.S. Cl. ..... 362/35; 362/277; 362/457; 362/458; 350/6.9; 350/6.91

[58] Field of Search ..... 362/35, 457, 458, 277; 350/6.7, 6.8, 6.9, 6.91

[56] References Cited

U.S. PATENT DOCUMENTS

| | | | |
|---|---|---|---|
| 1,961,116 | 5/1934 | Van Braam Van Vloten | 362/35 X |
| 3,420,594 | 1/1969 | Chapman | 350/6.9 X |
| 3,710,098 | 1/1973 | Walden | 362/35 |
| 3,987,296 | 10/1976 | Coppola et al. | 362/277 |
| 4,104,615 | 8/1978 | Hunter | 362/35 X |
| 4,256,364 | 3/1981 | Minoura et al. | 350/6.91 X |
| 4,353,110 | 10/1982 | Ellis | 362/35 |
| 4,392,187 | 7/1983 | Bornhorst | 362/85 X |

*Primary Examiner*—Larry Jones

*Attorney, Agent, or Firm*—Lackenbach, Siegel, Marzullo & Aronson

[57] ABSTRACT

The present invention provides a light display system for projecting a double-pattern light display. A luminaire holding the lamp and light control devices and projecting a primary first light beam is fixed to a first housing that in turn is nonrotatably mounted to a control bar. A second housing containing a fixed reflector apparatus adapted to receive a light beam from the luminaire is connected to and rotatable relative to the first housing about a first axis. At least two mirrors fixed to the second housing are positioned at an angle relative to the first axis and receive portions of the first light beam as second light beams. The fixed mirrors are rotatable with the second housing about the first axis. The rotatable mirrors project the second light beams to at least two rotatable mirrors each associated with a fixed mirror and the rotatable mirrors project the second light beams as third light beams about a second axis transverse to the first axis. A tilt driver attached to the second housing rotates the rotatable mirrors about the second axis. Shafts radially extend from the tilt drivers along the second axis to the rotatable mirrors for rotation and support. The light beams are thus moved simultaneously about two axes so as to cast double patterned lights on the environment.

16 Claims, 12 Drawing Sheets

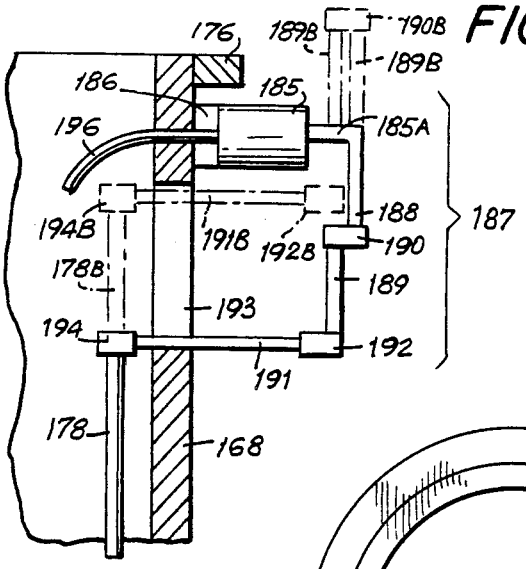
FIG. 8
FIG. 9
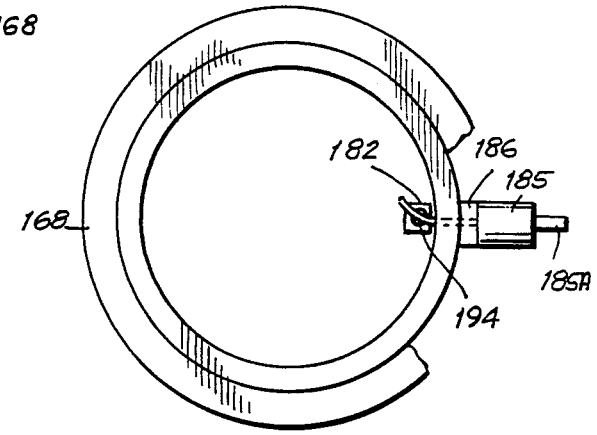
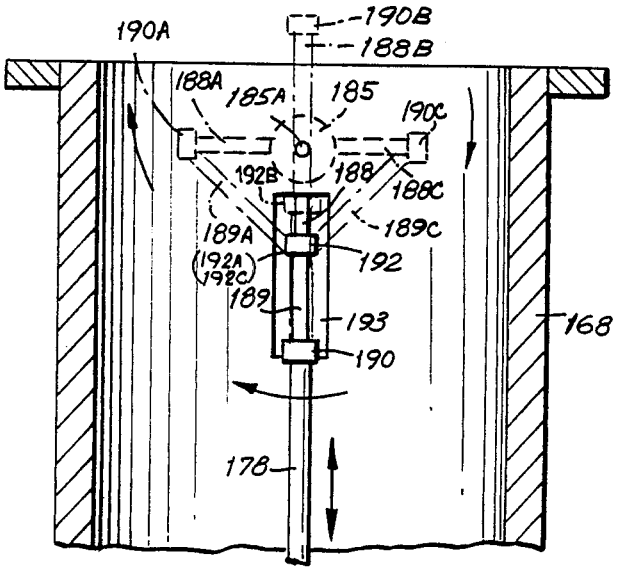
FIG. 10

FIG.23.
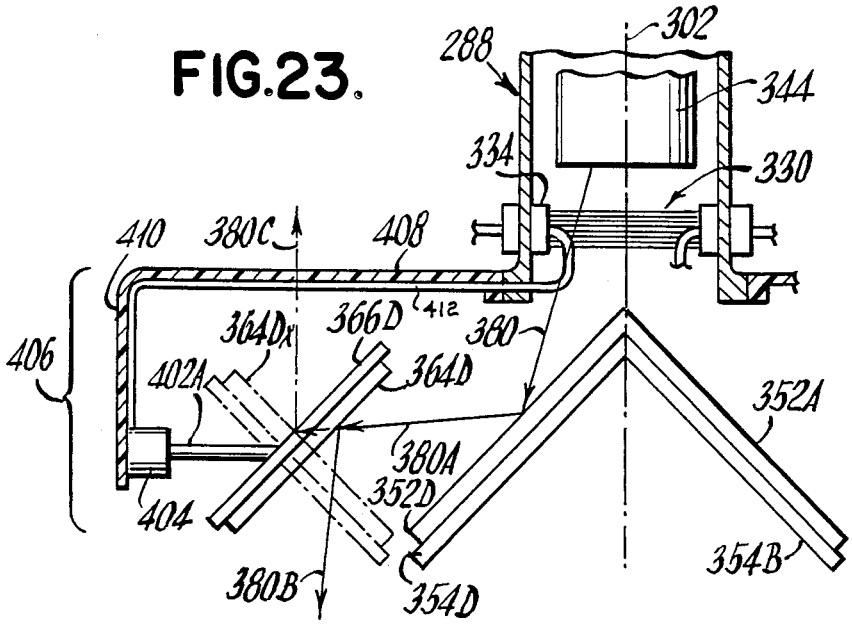
FIG.22.
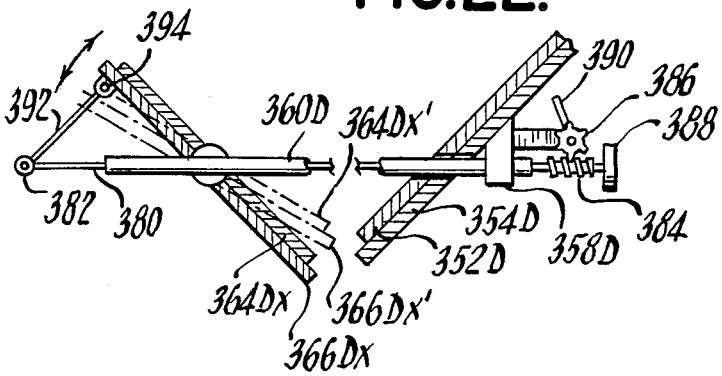
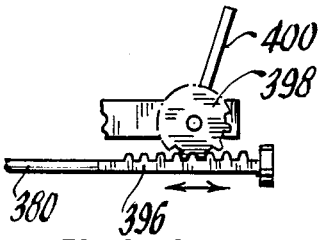
FIG.22A.

LOW-INERTIAL BEAM DIRECTION LIGHTING SYSTEM

HISTORY OF THE INVENTION

This application is a continuation-in-part application of an application entitled "Low-inertial Beam Direction Lighting System", Ser. No. 926,632, filed Nov. 3, 1986, now U.S. Pat. No. 4,729,071, 3/1/88.

FIELD OF THE INVENTION

This invention relates to light projection systems and more particularly to a light display apparatus that projects decorative patterns.

BACKGROUND OF THE INVENTION

Light projection systems used for such purposes as spotlights for theatrical situations such as stage productions and concerts are not adaptable for use in the type of varied light displays required as decorative backgrounds for such environments as popular music concerts or nightclubs. Such decorative displays are intended to create a general illusion or effect rather than to systematically illuminate performers or objects. The light display systems being used are generally projections of a single light beam that is moved in a single projection pattern.

Light beams used to decorate an area are known. The simplest type uses a single mirror that generally is rotated about a single vertical axis. The optical integrity of a single mirror system is limited because to get a constantly moving pattern the mirror must be tilted almost parallel to the incoming rays with the result that some rays will bypass the mirror entirely, which bypassing rays will not rotate but will be stationary, so that the whole moving decorative effect is spoiled Another decorative lighting system is known by the trade name of Vari-Lite. This system is described in U.S. Pat. No. 4,392,187. Although a continuously moving light covering substantially a full spheroid by using simultaneous pivotal movement of the light beam over an X-Y axis is achieved, the system is flawed in that the entire luminaire containing the lamp, iris, lens, shutter, color changer, dimmer, and special effects pattern device. The resulting inertial problems of revolving this mass, including power, operational, and cost problems of this system, are not to be minimized.

Patents cited in the prosecution of application Ser. No. 926,632 include the following U.S. patents:

U.S. Pat. No. 1,961,116 issued to Van Braam van Vloten on May 29, 1934.

U.S. Pat. No. 3,420,594 issued to Chapman on Jan. 7, 1969.

U.S. Pat. No. 3,710,098 issued to Walden on Jan. 9, 1973.

U.S. Pat. No. 3,987,296 issued to Coppola et al. on Oct. 19, 1976.

U.S. Pat. No. 4,256,364 issued to Minoura et al. on Mar. 17, 1981.

U.S. Pat. No. 4,353,110 issued to Ellis on Oct. 5, 1982.

SUMMARY OF THE INVENTION

It is an object of this invention to provide a multiple mirror lighting system that will illuminate an environment with a constantly moving light that illuminates a wide area in a continuous, simultaneous, multiple-pattern display, that is, movement of a single light beam generally on an X-Y axis, with a minimum of inertial mass being rotated.

It is another object of this invention to provide a multiple mirror light display system that can be directed at an area to be decorated by illumination in a continuous double-pattern display that is directed over substantially a full spheroidal volume, and that minimizes inertial impediments caused by the rotating mass by providing a stationary luminaire.

It is another object of this invention to provide a multiple mirror light display system that directs a light beam over a full spherical area without dark spots or nonmoving lighted areas and that has a stationary luminaire.

In accordance with these and other objects, there is provided a light display system for projecting a double light pattern that comprises a first stable housing, a second housing connected to and rotatable relative to the first stable housing centered about a first axis, a lamp assembly apparatus, or luminaire, connected to the first housing for projecting a primary first light beam, a fixed reflector apparatus fixedly connected to the second housing that is for receiving portions of the first light beams as a plurality of second light beams and directing the second light beams away from the first axis, a first drive mechanism connected to the first housing for rotating the second housing including the fixed reflector apparatus about the first axis, a rotatable reflector apparatus rotatably connected to the second housing for receiving the plurality of second light beams from the fixed reflector apparatus, the rotatable reflector apparatus being rotatably movable about a second axis transverse to the first axis, the rotatable reflector apparatus further being for receiving the second light beamsand continuously directing the second light beams as third light beams generally about the second axis, and a second drive mechanism connected to the second housing for rotating the rotatable reflector apparatus. The second housing includes a cylindrical mounting member positioned between the lamp assembly and the fixed reflector apparatus, the mounting member having a cylindrical passage axially aligned with the first axis, the lamp assembly apparatus directing the primary light beam through the cylindrical passage to the fixed reflector apparatus. The first drive mechanism is an electric motor that rotates the cylindrical mounting member by way of a pulley gear, a belt drive, and a drive gear mounted to the outer side of the cylindrical mounting member. The fixed reflector apparatus can include two or more fixed mirrors each positioned at an angle relative to the first axis. The rotatable reflector apparatus includes two or more rotatable mirrors each associated with a fixed mirror. The second drive mechanism includes second electric motors for each rotatable mirror connected to the second housing. Shafts connected to the second motors radially extend from the second electric motors along the second axis to the rotatable mirrors and both drive and support the rotatable mirrors. The light beams are thus moved simultaneously about two axes so as to cast double patterned lights on the environment.

The present invention will be better understood and the main objects and important features, other than those enumerated above, will become apparent when consideration is given to the following details and description, which when taken in conjunction with the annexed drawings, describes, discloses, illustrates, and shows the preferred embodiments or modifications of the present invention and what is presently considered and believed to be the best mode off practice in the principles thereof. Other embodiments or modifications may be suggested to those having the benefit of the teachings herein and such other embodiments or modifications are intended to be reserved especially as they fall within the scope and spirit of the subjoined claims.

The present invention will be better understood and the main objects and important features, other than those enumerated above, will become apparent when consideration is given to the following details and description, which when taken in conjunction with the annexed drawings, describes, discloses, illustrates, and shows the preferred embodiments or modifications of the present invention and what is presently considered and believed to be the best mode of practice in the principles thereof. Other embodiments or modifications may be suggested to those having the benefit of the teachings herein; such other embodiments or modifications are intended to be reserved especially as they fall within the scope and spirit of the subjoined claims.

BRIEF DESCRIPTION OF THE DRAWINGS

The invention will be better understood from the following description of specific embodiments of the invention together with the accompanying drawings wherein similar reference characters denote similar elements throughout the several views, in which:

FIG. 8 is a simplified sectional side view of the tilt motor driving a crank mechanism moving a vertical rack;

FIG. 9 is a top view of the cylindrical mounting member, rack, tilt motor, and slide stabilizers of the mounting member;

FIG. 10 is a sectional side view of the crank mechanism driving the rack;

FIG. 22 is a detail view of an adjustable rotatable mirror;

FIG. 22A is a detail view of an alternate embodiment of an adjusting mechanism for the adjustable rotatable mirror of the type shown in FIG. 22; and FIG. 23 is a detail view of an alternate embodiment for mounting the rotatable mirrors shown in FIG. 20.

DESCRIPTION OF THE PREFERRED EMBODIMENTS

Figure 6:
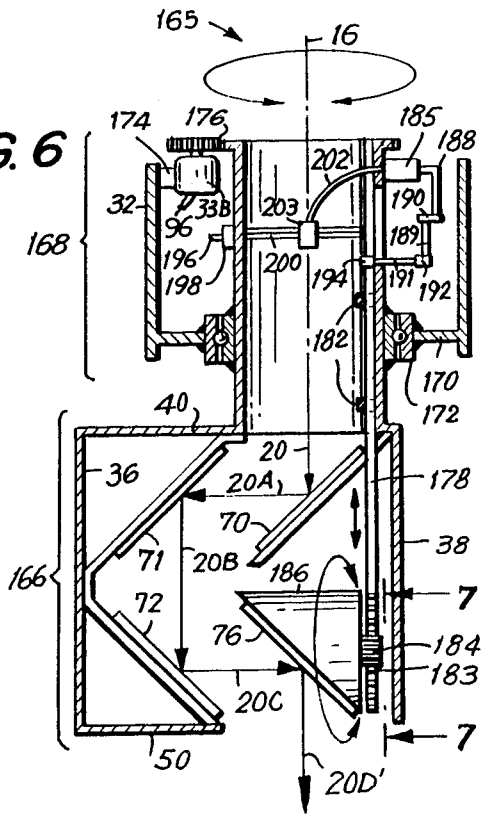
FIG. 6 is still another view of the invention having a vertically movable rotatable mirror to create the second light pattern.

Reference is now made to the drawings and in particular to FIGS. 1-10 in which identical or similar parts are designated by the same reference numerals throughout.

Figure 1:
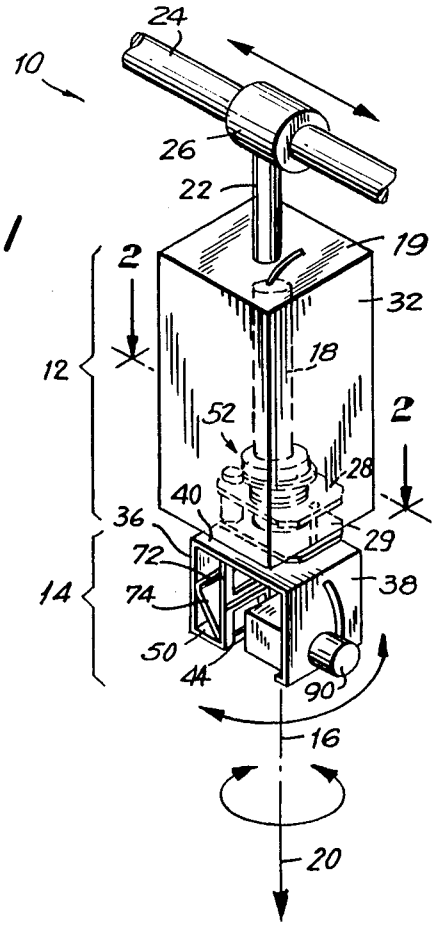
FIG. 1 is a perspective view of the double pattern lighting system shown hung from a mounting bar.
Figure 2:
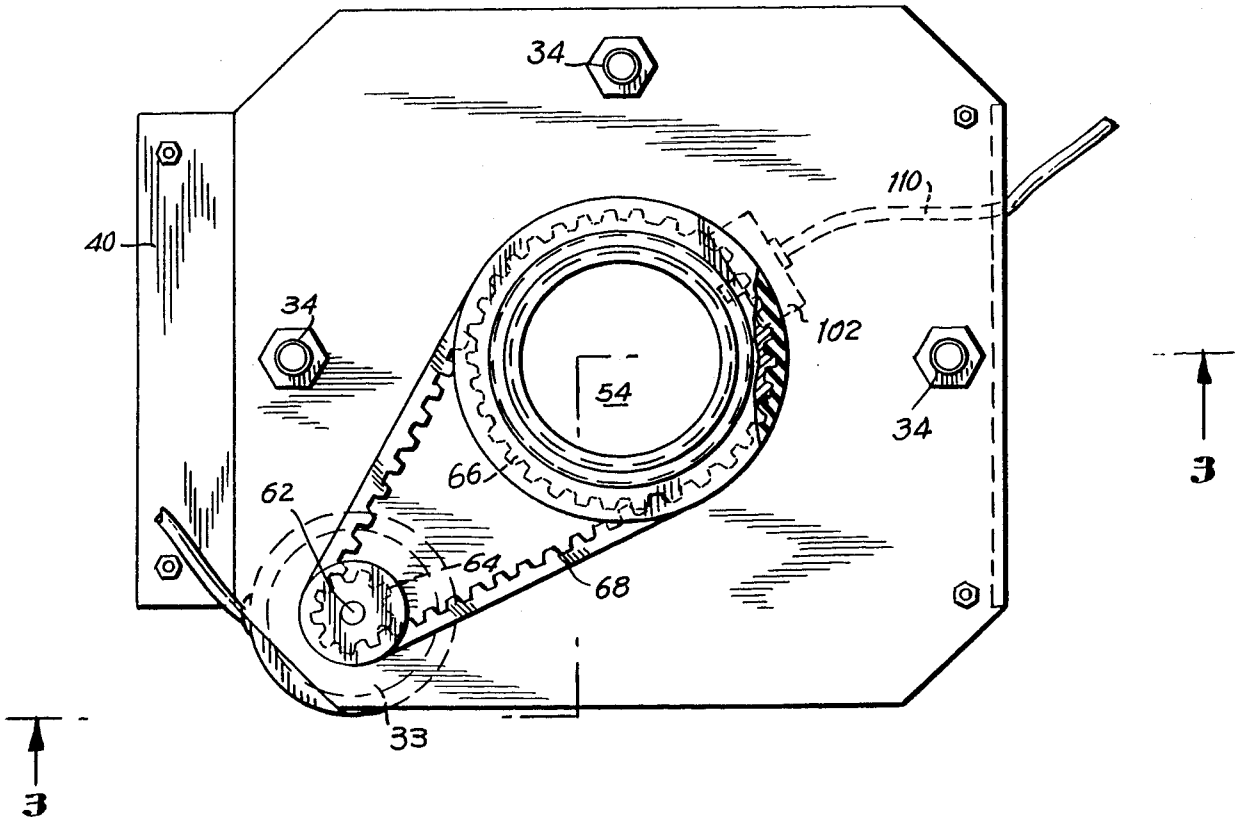
FIG. 2 is a sectional view taken through the plane 2—2 of FIG. 1.
Figure 3:
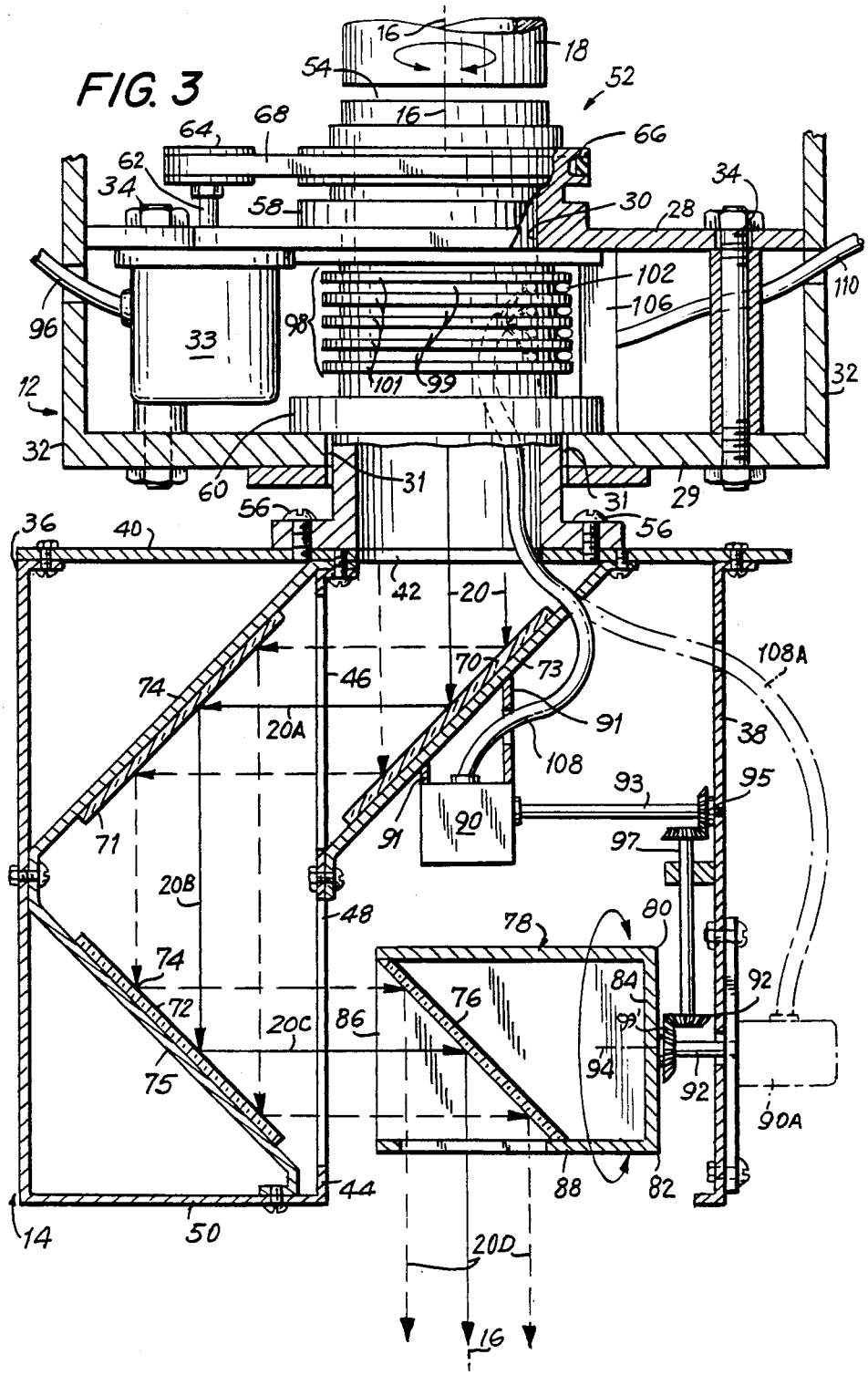
FIG. 3 is a sectional view taken through line 3—3 of FIG. 2.

A light display system 10 shown in FIGS. 1-3 includes a stationary upper housing 12 and a lower housing 14 connected to and rotatable relative to upper housing 12 about a vertical axis 16. A vertically hung, stationary luminaire 18 is mounted in upper housing 12 under the top wall 19. As shown in block diagram in FIG. 15, a typical luminaire 18 includes a lamp 18A, an iris-pattern 18B, a focus lens 18C, and an optional color changer 18D. The luminaire unit is operable by remote control. A light beam 20 is projected from luminaire 18 centered along an axis 16 in a manner to be described below. A vertical rod 22 secured to top wall 19 connects upper housing 12 to a horizontal bar 24 by way of a gripping ring 26 slidably connected to bar 24. As best seen in FIG. 2 and particularly in FIG. 3, a pair of horizontal, spaced upper and lower support plates 28 and 29, respectively, having circular holes 30 and 31, respectively, are connected at their rectangular peripheries to the vertical side walls 32 of upper housing 12 in a manner known in the art. An electric motor 33 is located between upper and lower support plates 28 and 30 and in particular is mounted to the underside of upper support plate 28. Three vertical bolts 34 aid in keeping plates 28 and 30 in alignment.

Lower housing 14 is generally rectangular and includes a pair of opposed vertical side wall plates 36 and 38 connected by a horizontal top wall plate 40 having a circular hole 42. A vertical plate 44 spaced from side wall plate 36 and having top and bottom apertures 46 and 48, respectively, is bolted to top plate 40 and secured by welding or similar method to a horizontal bottom plate 50 that in turn is connected to the bottom of side wall plate 36 by welding or similar method.

A vertical cylindrical mounting member 52 has a cylindrical passage 54 having an axial center at vertical axis 16 centered on hole 42 and is bolted to top wall plate 40 by a number of bolts 56 through a circular flange extending outwardly from the bottom rim of mounting member 52, which is aligned with the rim of hole 42. Cylindrical mounting member 52 extends through circular holes 30 and 31 of opposed support plates 28 and 29. Upper and lower bearings 58 and 60 are operatively positioned between cylindrical mounting member 52 and support plates 28 and 30 so that lower housing 14 is rotatably supported relative upper housing 12 during rotation of lower housing 14 about axis 16.

As shown in FIGS. 2 and 3, motor 33, which is positioned proximate to cylindrical mounting member 52, has a drive shaft 62 extending vertically upwardly with a connecting pulley 64 that transmits power to a gear 66 positioned around the outer surface of the upper portion of cylindrical mounting member 52 via a drive belt 68. When motor 33 is activated, cylindrical mounting member 52 is rotated thus rotating lower housing 14, which is integral with cylindrical mounting member 52.

Lower housing 14 supports a fixed reflector apparatus that includes first, second, and third tilted mirrors 70, 71, and 72, respectively, each mounted on respective first, second, and third support plates 73, 74, and 75, which are bolted to top wall plate 40, vertical plate 44, and side wall plate 36, and bottom plate 50 at certain angles. First mirror 70 is positioned at a 45° angle with axis 16 and light beam 20 so as to receive light beam 20 from luminaire 18 via cylindrical passage of mounting member 52. Beam 20 is directed at right angles towards side wall plate 36 where the beam, designated as beam 20A, is received by second mirror 71, which is positioned at a 45° angle to beam 20 so as to direct the beam, designated as beam 20B, at right angles downwardly parallel to beam 20 to third mirror 73, which is positioned at a 45° angle relative to beam 20B so as to receive beam 20B and direct the beam, designated as beam 20C, at right angles relative to beam 20B, back towards the center area of lower housing 14. Light beams 20, 20A, 20B, 20C, and, as will be discussed below, light beam 20D are generally cylindrical and centered around axes designated as the light beams. FIG. 3 indicates the general area of the light beam in dotted lines. Subsequent embodiments of the invention indicate only the center axes of the light beam about which the beams are centered.

A rotatable mirror 76 is also mounted in lower housing 14. As shown in FIG. 3, rotatable mirror 76 is positioned at a 45° angle relative incoming light beam 20C in a mirror housing 78 which has opposed horizontally extending walls 80 and 82, respectively, to which the ends of rotatable mirror 76 are attached, and a vertical rear wall 84 attached to horizontal walls 80 and 82. Housing 78 has an open side 86 through which incoming beam 20C passes to rotatable mirror 76. Wall 82 has an aperture 88. Rotatable mirror 76 is so angled relative to incoming light beam 20C that after light beam 20C is received by rotatable mirror 76 the light beam, designated as light beam 20D, is directed from the rotatable mirror at right angles relative incoming beam 20C through aperture 88. As shown in FIG. 3, light beam 20D is axially centered along axis 16 so as to make it continuous with originally projected beam 20. It is noted that having beams 20 and 20D axially aligned is preferable since if beam 20D were offset from beam 20, a non-illuminated area, or dark spot, at the projected area of axis 16 would result. With the configuration shown in FIG. 3, a moving spotlight is continuously moved over over substantially a full spherical area. It is noted that the beam will be interrupted by interference at housing 32 and mounting member 52.

An electric motor 90 is positioned within lower housing 14 at a location generally coaxial with the axis of beams 20 and 20D, which is also the axis of rotation of lower housing 14. In this position motor 90 is generally coaxial with the center of inertia of the rotating mass. Motor 90 is held in place by mounting rods 91 which are connected to mirror support plate 73, but other mounting devices may be used. A horizontal drive shaft 93 connected to the drive shaft of motor 90 extends to a pair of bevel gears 95 which drive a vertical shaft 97 which in turn is connected to another pair of bevel gears 99 which are connected to the horizontal shaft 92 of rotating mirror housing 78. A horizontal drive shaft 92 that is aligned with incoming light beam 20C of motor 90 extends through side wall plate 38 and is mounted to rear wall 84 of rotatable mirror housing 78. When motor 90 is activated, light beam 20D is continuously projected through aperture 88 over a 360° movement. Because light beam 20D is preferably projected at right angles to shaft 92, the geometric pattern projected at right angles projected by light beam 20D is a vertical plane pivoted along axis 16. If another angle of projection rather than the right angle projeciion of light beam 20D illustrated is selected, another configuration than the vertical plane generated will be generated, with the result that a dark area devoid of light will result directly below axis 16; for this reason a vertical plane is the preferred geometrical configuration. Also, as stated earlier, the vertical plane generated by light beam 20D is preferably aligned with axis 16 so as to avoid an offset dark spot below axis 16. Light beam 20D continues to project away from light display system 10 until it strikes an object in the theatrical environment in which system 10 is located.

An alternate embodiment to motor 90 is shown in phantom lines in FIG. 3 as electric motor 90A, which is secured to the outer side of side wall plate 38 by way of a connecting plate bolted to wall 38. The drive shaft of motor 90A is connected to shaft 92 of housing 78.

When motor 33, which rotates lower housing 14, is activated at the same time motor 90 is activated, light beam 20D is projected by the panning motion of lower housing 14 and the tilting motion of motor 90 so that a double decorative light pattern is created over the walls and objects of the environment in which system 10 is located. That is, the vertical plane over which beam **20*d* is projected by tilt motor 90 is at the same time being rotated about axis 16 by pan motor 33. Thus, a continuous spotlight is sent over the walls of the environment in an interweaving double decorative pattern that is based upon simultaneous rotations about vertical axis 16 and horizontal axis 94. It is noted that light beam 20D will strike portions of upper and lower housings 12 and 14 when beam 20D extends upwardly so that the decorative light pattern will not strike the environment during movement of beam 20D** through those blocked portions of the 360° planar rotation.

Pan motor 33 is stationery and is connected to a source of electrical power by an external conductor 96 via a transformer and a controller (not shown). Tilt motor 90, because it is being continuously rotated along with lower housing 14 by pan motor 33, is electrically connected to the source of electrical power by way of a slip-ring connector assembly 98 that is integral with cylindrical mounting member 52. Slip-ring connector assembly 98 includes a number of cylindrical electrical conductors 99, shown here as four for purposes of exposition only, which are made of an electrically conductive material such as graphite and which are isolated from one another by cylindrical nonconductive insulators 101 that extend between the inner and outer surfaces of slip-ring connector assembly 98, which surfaces are integral, or continuous with, the inner and outer surfaces of cylindrical mounting member 52. Four outer connecting brushes 102 held by a brush holder 106 are connected to the source of electrical power via a transformer and a controller (neither shown) by way of an outer conductor 110. An inner conductor 108 extends between tilt motor 90 and four inner electrical contacts 111, which are positioned in cylindrical passage 54 in such a manner that they do not interfere with light beam 20. Tilt motor 90 is thus in continuous electrical contact with the power source even though it rotates along with its electrical contacts 11 and inner conductor 108. Inner conductor 108A is shown electrically connecting alternate embodiment motor 90A. The plurality of separate brushes and electrical contacts, shown as four for purposes of exposition, and the four equal number of graphite rings, provide paths for separate power signals to tilt motor 90 in accordance with instructions entered at the controller by the operator. The direction of rotation of pan and tilt motors 33 and 90 can be programmed to be periodically reversed throughout the operational mode of the system.

Figure 4:
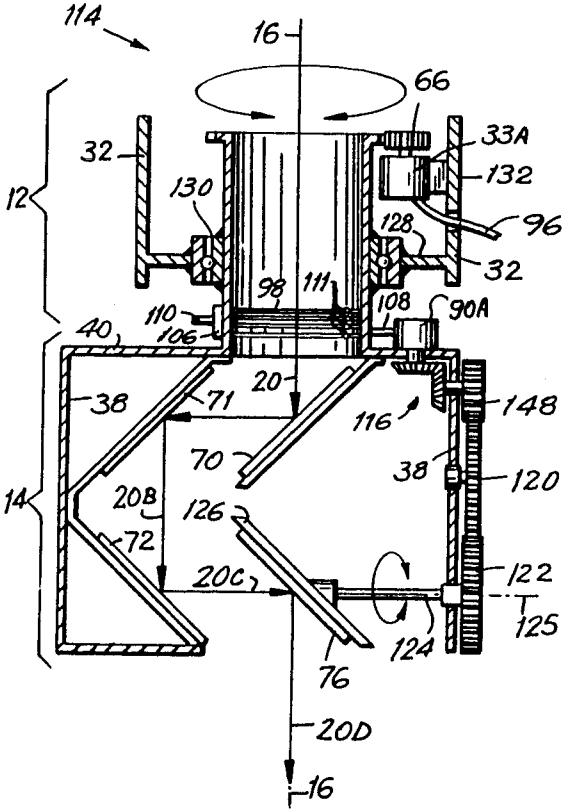
FIG. 4 is an elevational sectional view of another embodiment of the invention having an alternative tilt mechanism.

Another embodiment of the invention is shown in a simplified drawing in FIG. 4 where a light display system 114 having many basic features analogous to the system shown in FIGS. 1-3 includes lower housing 12, cylindrical mounting member 52 with slip-ring connector assembly 52, first, second, and third fixed mirrors 70, 71, and 72, and rotatable mirror 76 are shown. A tilt motor 90A is shown positioned on top wall plate 40 adjacent cylindrical mounting member 40 employs a drive system to rotate rotatable mirror 76. Specifically, a vertical drive shaft 115 of tilt motor 90A extending through top wall plate 40 is connected to a pair of bevel gears 116 the second gear of which drives a pulley gear 118 via a bevel gear drive shaft that extends through side wall plate 38. Pulley gear 118 is attached to a belt 120 that operates a drive gear 122, which rotates a horizontal shaft 124 about horizontal axis 125 and operatively connected to an angled support plate 126 that mounts rotatable mirror 76. It is noted that the embodiment of FIG. 4 uses support plate 126 in lieu of the housing 78 shown in FIG. 3. The embodiment of FIG. 4 also shows a single cross-plate 128 that is secured to side walls 32 of upper housing 12 and which has a hole in which cylindrical mounting member 52 is positioned. Bearings 130 are positioned between the inner periphery of the hole in cross-plate 128 and cylindrical mounting member 52. Pan motor 33A is secured to the inner surface of side wall 32 by a bracket 132. Motor 33A drives cylindrical mounting member 52 and lower housing 14 in the same gear and belt system as does motor 33 shown in FIGS. 1-3.

Figure 5:
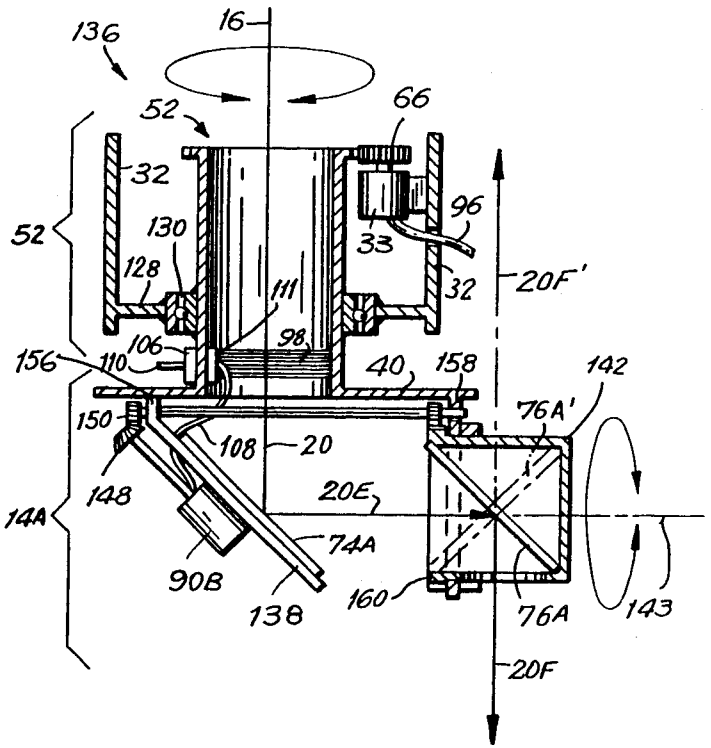
FIG. 5 is yet another elevational view of yet another embodiment of the invention having a second reflector positioned outside the lower housing.

Another embodiment of the present invention indicated as light display system 136 is shown in FIG. 5 with a modified lower housing 14A and cylindrical mounting member 52. Cross-plate 128, pan motor 33A and slip ring 98 are as shown in FIG. 4. Display system 136 includes two features that vary from the features shown in FIGS. 1-3 and FIG. 4.

The first primary distinguishing feature of the embodiment shown in FIG. 5 is that a single fixed mirror 74A with its mirror support 138 is used. Light beam 20 strikes fixed mirror 74A at a 45° angle so as to project the beam as light beam 20E horizontally to rotatable mirror 76A, which receives beam 20E at a 45° angle and projects the beam, shown as beam 20F, in a vertical plane about a 360° rotation. The lower housing 14A includes primarily top wall plate 40 from which fixed mirror support 138 is hung.

The second primary distinguishing feature of FIG. 5 is a rotatable mirror 76A mounted away from upper housing 52 in a cylindrical walled housing 142 rotatable about a horizontal axis 143 aligned with beam 20E. Cylindrical housing 142 positions mirror 76A at a 45° angle relative to beam 20E so that a final beam 20F projected from mirror 76A is rotated over a 360° sweep in a plane parallel with original light beam 20 so that beam 20F is projected through an aperture 144 in housing 142 free of interference by upper housing 12. In FIG. 5 this uninterrupted planar sweep is indicated by rotatable mirror being positioned in position 76A' as shown in phantom line so that the final beam projects vertically upwards as shown in phantom line as beam 20F'. A tilt motor 90B for rotating housing 142 so as to rotate rotatable mirror 76A is secured to the rear side of fixed mirror support 138. The drive shaft 146 extends along the underside of fixed mirror support 138 to a first bevel gea 148 that engages a second bevel gear 150 of the at a 45° angle with first gear 148. Second gear 150 is secured to a horizontal cross-shaft 152 that is rotatably mounted in suitably journaled brackets 156 and 158 hung from opposite sides of top wall plate 40, bracket 156 being located above fixed mirror **74*a* and bracket being located above rotatable mirror 76A. A drive gear 154 vertically mounted to cross-shaft 152 opposite second bevel gear 150 engages an external gear 160 fixed to the rim of cylindrical housing 142 that is nearest to fixed mirror 74A so that when tilt motor 90B is activated, cylindrical housing 142 and rotatable mirror 76A are rotated. Cylindrical housing is rotatably mounted with bearing supports in bracket 158, which extends downwardly so as to support cylindrical housing 142. Pan motor 33A, which is mounted in the same manner as tilt motor 33A in FIG. 4, is generally operated simultaneously with tilt motor 90B so that a decorative double pattern is created as the plane of beam 20F is rotated both vertically and horizontally. Direction and speed of rotation can be varied in accordance with programmed instructions at the controller. A conductor 108 connects tilt motor 90B with inner brush holder 102 and its brushes which transmit power from the brushes of outer brush holder 106**.

Figure 7:
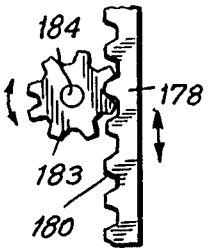
FIG. 7 is a view taken through line 7—7 in FIG. 6.

Another embodiment of the present invention is shown in the simplified cross-sectional drawing shown in FIG. 6, which illustrates a light display system 165 that includes a lower housing 166 similar to lower housings 14 of the embodiments of shown in FIGS. 3 and 4 and three fixed mirrors 70, 71, and 72 and rotatable mirror 76, which are the same as the mirrors shown in the embodiments of FIGS. 3 and 4. Light beams 20, 20A, 20B, and 20C are the same as those described in relation to the descriptions for FIGS. 3 and 4. A cylindrical mounting member 168 is secured to lower housing 166; mounting member 168 is analogous to cylindrical mounting members 52 shown in FIGS. 4 and 5, with differences that will now be discussed. A horizontal supporting cross-plate 170 connected to side walls 32 of the upper housing is rotatably mounted to the cylindrical wall of cylindrical mounting member 168 at circular bearings 172. A pan motor 33B is secured to side wall 32 of the upper housing by a bracket 174. A pulley 176 attached to the drive shaft of the motor acts to rotate cylindrical mounting member 168 and lower housing 166 by way of a drive belt (not shown) and an axial drive gear (not shown) mounted on top of the cylindrical mounting member in a manner similar to that discussed with relation to the embodiments for FIGS. 4 and 5. A vertical rack 178 having teeth 180 on one face, as shown in FIG. 7, is slidably mounted to the inner side wall of cylindrical mounting member 168 by brackets 182. Rack 178 extends downwardly into the interior of lower housing 166 where at the bottom portion of rack 178 teeth 180 are geared with a pinion gear 183 that in turn is fixed to the horizontal axial shaft 184 of fixed mirror support 186.

A tilt motor 185 is secured to the outer side of the upper portion of cylindrical mounting member 168 by a bracket 186 just below pulley 176. Drive shaft 185A of tilt motor 185 drives a crank mechanism 187 connected to rack 178 that acts to raise and lower rack 178 at such a distance that pinion gear 183 is rotated in opposite directions at such a rotational distance that rotatable mirror 76 moves 180° in one direction and then 180° in the opposite direction so that a full 360° sweep of light beam 20D' is accomplished. Crank mechanism 187 includes a crank arm 188 fixed to the drive shaft of tilt motor 185, a rocker arm 189 movably secured to crank arm 188 by a first link 190 and movably secured to a horizontal drive arm 191 by a second link 192. First link 190 allows movement of rocker arm 189 in a vertical plane relative to crank arm 188 and second link 192 allows movement of rocker arm 189 in a vertical plane relative to drive arm 191. Horizontal drive arm 191 extends through a vertical guide slot 193 formed in the side wall of cylindrical mounting member 168 to a third link 194 that is also attached to the top end of rack 178. Third link 194 allows movement of drive arm 191 in a vertical plane relative to rack 178. Drive arm 191 moves vertically up and down in guide slot 193 in response to the position of crank arm 188, which moves rocker arm 189, which in turn moves horizontal drive arm 191 so as to raise or lower rack 178 at a regular speed. Thus, light beam 20D' is tilted 180° in one direction then 180° in the opposite direction in a 360° tilt movement. For purposes of exposition, positions of crank mechanism 187 are shown at four positions, from the fully lowered to the fully raised positions of rack 178, the former shown in solid line and three successive positions shown in phantom line. Crank arm 188, rockerarm 189, and drive arm 191 are shown with A,B, and C suffixes at 90°, 180° (fully raised), and 270° positions with first, second, and third links 190, 192, and 191 shown in the same manner in FIG. 9 with rack 178 shown as 178B in its top position. Drive arm 191B and second link 192B positions are seen in FIG. 8. An external conductor 196 is connected to an external brush holder 198 having brush contacts (not shown) in contact with a slip ring 200 integral with cylindrical mounting member 168 at one end and to a power source, including a controller and a transformer (not shown) at the other end. An internal conductor 202 is connected to tilt motor 185 at one end and to an internal brush 203 having brush contacts (not shown) at the other end connected to slip ring 200. Crank mechanism moves rack 178 up and down so that pinion gear 182 acts to rotate fixed housing shaft 184 and thus fixed mirror 76 in two directions so that a final light beam 20D' is directed in a plane parallel to original light beam 20. In this embodiment, light beam 20D' can be rotated less than 360° so as to avoid the interference caused by the upper and lower housings in accordance with the movement programmed for the up and down movement of rack 178 by tilt motor 190. Light beam 20D' is directed in a double pattern when pan motor 33B is being operated so as to rotate the plane of beam 20D'. Light beam 20D' is centered along axis 16 in the same manner as light beam 20D is in FIGS. 3 and 4.

Figure 11:
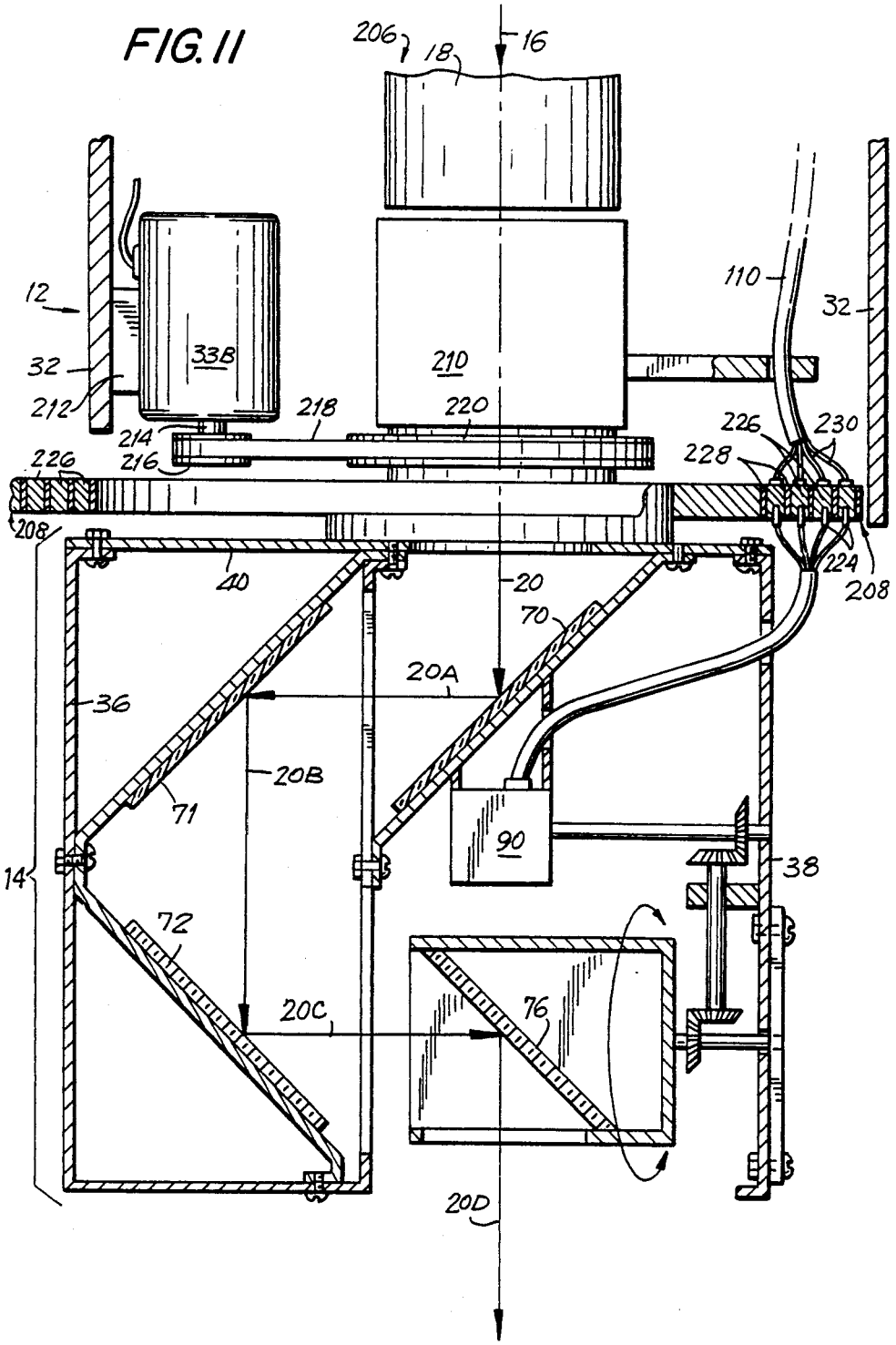
FIG. 11 is a sectional elevational view of the invention with a flat, horizontal slip ring.

FIG. 11 shows a light display system 206 is shown in FIG. 8 that is analogous to light display system 10 shown in FIGS. 1–3. In particular, the lower housing 14 is the same as lower housing 14 of FIGS. 1–3. System 206 includes a flat, horizontal slip ring 208 that is attached to the top of lower housing 14 and thus rotates with lower housing 14. A cylindrical mounting member 210 positioned in upper housing 12, like cylindrical mounting member 52 shown in FIG. 3, has a cylindrical passage (not shown) over which luminaire 18 is situated. A pan motor 33B analogous to pan motor 33 shown in FIG. 3 is secured by a bracket 212 to side wall 32 of upper housing 12. A drive shaft 214 extends vertically downwardly from motor 33B to a pulley gear 216, which is attached to a drive belt 218 in turn mounted to a drive gear 220 mounted around the lower periphery of cylindrical mounting member 210. Conductor 108 from tilt motor 90 extends upwardly to slip ring 208 where a plurality of lower contacts 224 are secured to conductor rings 226, which are surrounded by insulator rings 228. External conductor 110, which is connected to upper external brush contacts 230 that are in electrical contact with the same conductor rings 226 as lower electrical contacts 224, leads to a power source, including a transformer and a controller. Slip ring 208 rotates with lower housing 14 along with motor 90 and lower contacts 224.

Figure 12:
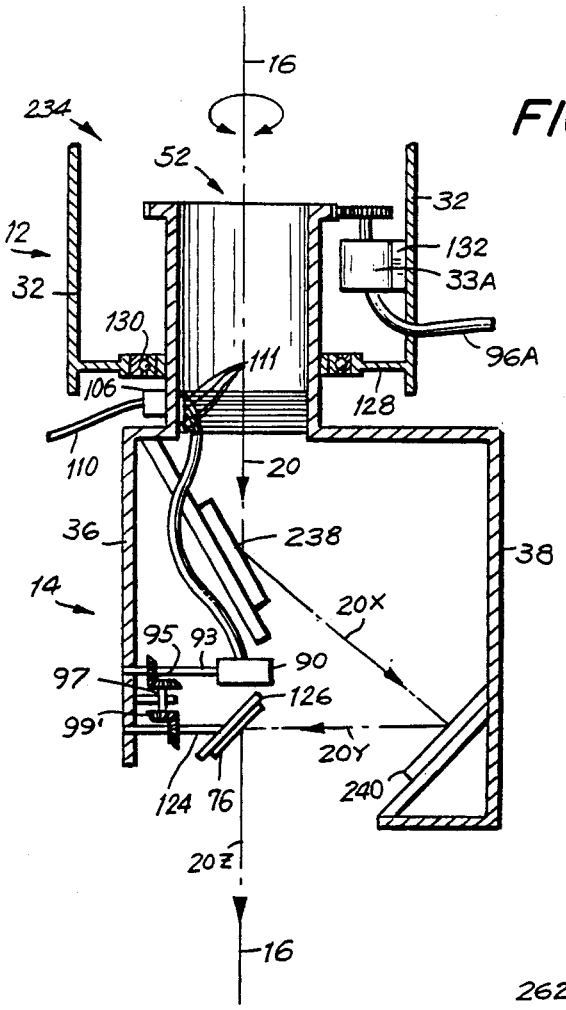
FIG. 12 is an elevational view of an embodiment of the invention having three mirrors.
Figure 15:
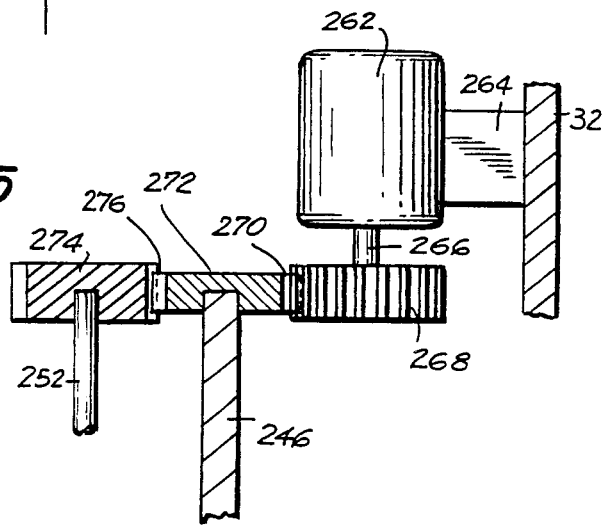
FIG. 15 is a diagram of the gear structure of FIG. 14.

A three-mirror light display system 234 show in FIG. 12 includes a cylindrical mounting member 52 with a pan motor 33A like that shown in FIG. 4, and a tilt motor 90 with a drive system like that shown in FIG. 3 including horizontal drive shaft 93, first bevel gearing 95, vertical drive shaft 97, and second bevel gearing 99' driving a mirror mounting 126 holding a rotatable mirror 76 like that shown in FIG. 4. System 234 includes mirrors 238 and 240 fixedly mounted in housing 14. Mirror 238 is secured to a first mirror mount so as to receive light beam 20 and direct it as light beam 20X at an angle to mirror 240 secured to a second mirror mount so as to direct beam 20X a light beam 20Y at right angles to light beam 20 and axis 16 to rottable mirror 76, which directs the beam in a 360° pattern as light beam 20Z axially aligned with axis 16. Rotatable mirror 76 is mounted to a rotatable mirror mount 126 having a horizontal shaft 124 connected to second bevel gearing 99. In this embodiment light loss from the fourth mirror shown in FIGS. 13, 14, and 15 is eliminated.

Figure 13:
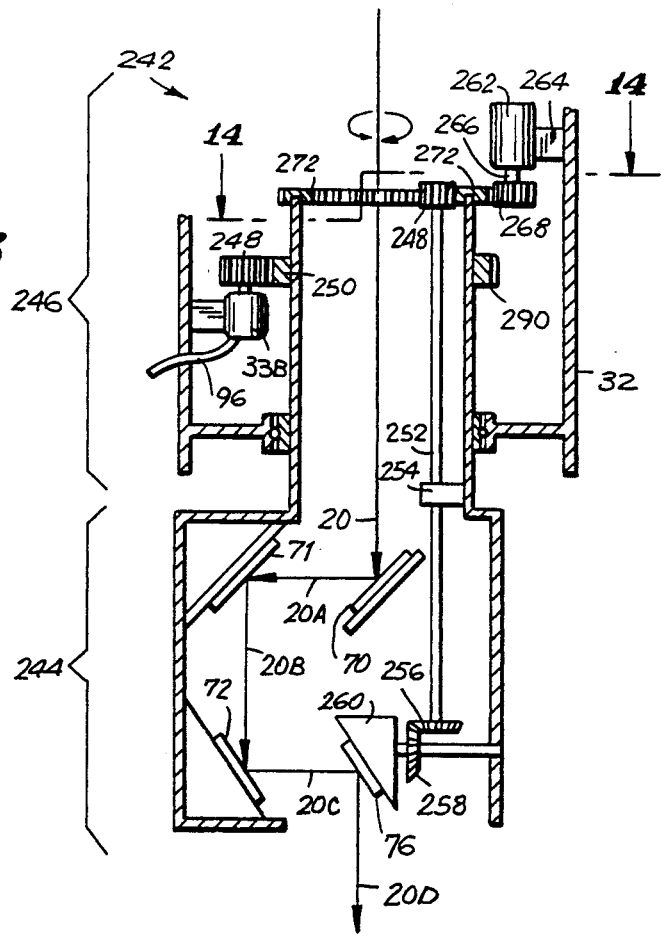
FIG. 13 is an elevational sectional view of another embodiment of the invention.
Figure 14:
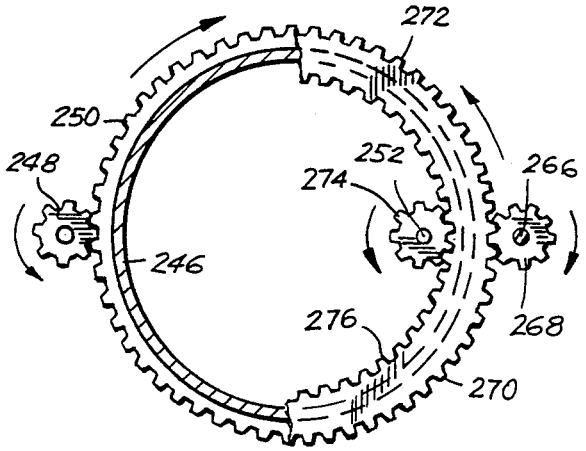
FIG. 14 is a sectional view taken through line 14—14 of FIG. 13.
Figure 15A:
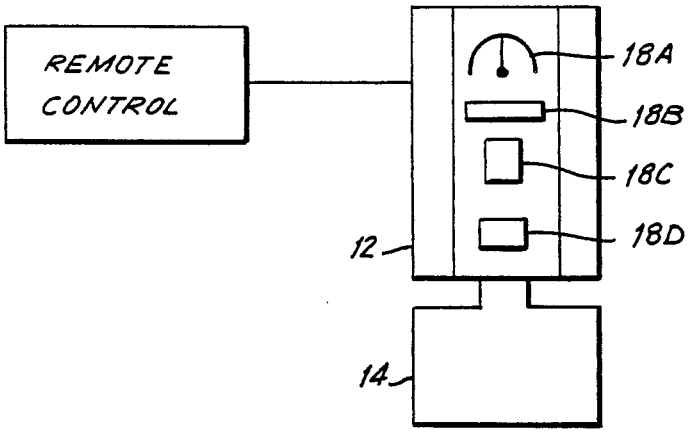
FIG. 15A is a block diagram of the luminaire display system.

FIGS. 13 and 14 illustrate another embodiment of the invention designated as light display system 242 which includes a lower housing 244, a cylindrical mounting member 246, and a pan motor 33B attached to housing 32 which rotates cylindrical mounting member 246 by gear 248 which meshes with external circular gear of mounting member 246. Light beam 20 is reflected at fixed mirror 70 to light beams 20A, 20B, 20C, and 20D via fixed mirrors 71 and 72 and rotating mirror 76 in a manner analogous to the systems shown in FIGS. 3, 4, 6, and 11. A vertical elongated drive shaft 252 positioned in cylindrical mounting member 246 is rotatably secured to the inner side of mounting member 246 at a bracket 254. The bottom end of shaft 252 is connected to a horizontal bevel gear 256 mated to a vertical bevel gear 258, which turns rotatable housing 260 upon which rotatable mirror 76 is mounted. A tilt motor 262 hung from the inner side of outer housing 32 by a bracket 264 has its drive shaft 266 connected to a horizontal drive gear 268 which is geared to the external teeth 270 of a ring gear 272 slidably mounted to the top of cylindrical mounting member 246. The top end of vertical drive shaft 246 is secured to a horizontal shaft gear 274 which is geared to the internal teeth of ring gear 272.

In operation, when pan motor 33B is in operation and tilt motor 262 is not in operation, cylindrical mounting member 246 rotates and in addition, as vertical drive shaft 252 is carried around with member 246, shaft gear 274 is being rotated by internal teeth 276 of ring gear 272, which is kept in a non-rotating mode by the intermeshing external teeth 270 of ring gear 272 and drive gear 268, with the result that mirror 76 is rotated by bevel gears 256 and 258. When tilt motor 262 is operated, drive gear 268 acts to rotate ring gear 272 relative to cylindrical mounting member 246 via external teeth 270 of the ring gear. When the direction of rotation of drive gear 268 is in the opposite rotational direction from pan gear 248, the speed of rotation of shaft gear 252 is increased. When the rotational direction of drive gear 268 is in the same direction as pan gear 248, the speed of rotation of shaft gear 252 is decreased. When drive gear 268 and pan gear 248 are of the same diameter and pan motor 33B and tilt motor 262 are rotating their drive shafts at the same speed, and the direction of rotation of drive gear 268 and pan gear 248 are the same, vertical drive shaft 252 is stationary and mirror 76 does not tilt.

Figure 16:
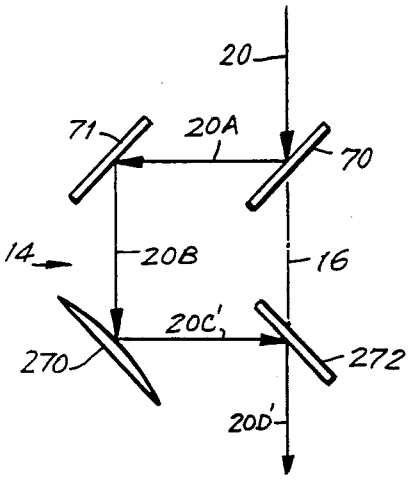
FIG. 16 is a schematic view of a mirror system that includes a convex mirror.
Figure 17:
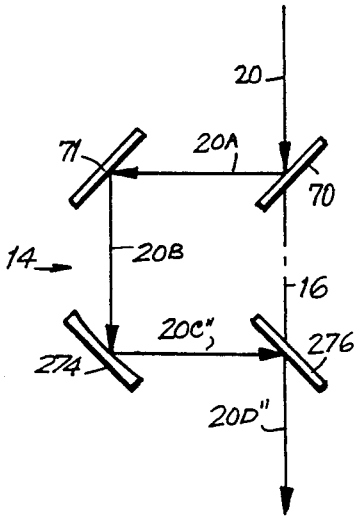
FIG. 17 is a schematic view of a mirror system that includes a concave mirror.

FIGS. 16 and 17 illustrate in schematic form embodiments of the invention that include possible alternate systems. FIG. 16 shows a mirror system mounted in a lower housing 14 containing first and second fixed mirrors 70 and 71 analogous to fixed mirrors 70 and 71 shown in FIG. 3. Mirror 70 directs light beam 20 as light beam 20A to mirror 71. A third mirror 270 fixed in lower housing 14 is convex in configuration and receives a light beam 20B directed from second mirror 71. Convex mirror 270 directs the light beam as a spread light beam centered along a central axis designated as light beam 20C', which is at right angles to axis of rotation 16, to a rotatable mirror 272, which receives the spread beam and directs it along a plane designated as light beam 20D', which is aligned with axis of rotation 16 and beam 20.

FIG. 17 shows a system similar to the one shown in FIG. 16 with light beam 20 being received by a concave mirror 274, which directs a concentrated light beam 20C''' at right angles to axis of rotation 16 to a rotatable mirror 276, which receives the concentrated beam and directs it as light beam 20D'' along an axis aligned with axis of rotation 16 and light beam 20. FIGS. 16 and 17 indicate the possibility of complex mirror systems that eliminate the need for any transmissive optical components such as glass lenses.

Further embodiments of the invention are set forth in detail below.

Figure 18:
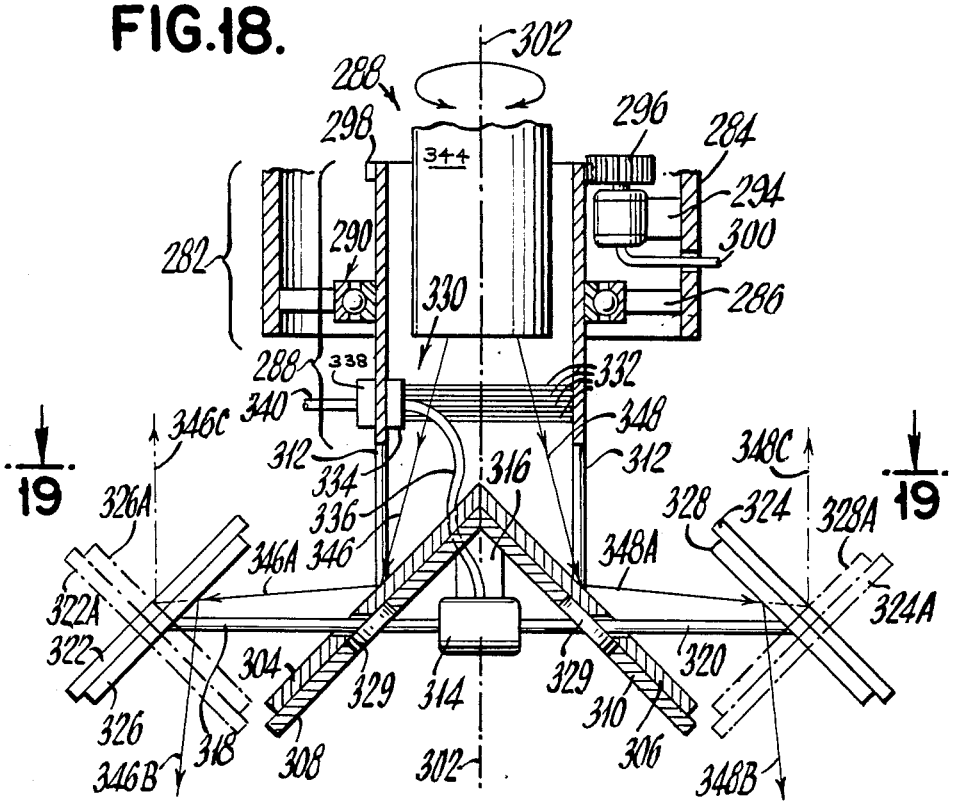
FIG. 18 is an elevational sectional view of another embodiment of the invention having a two rotatable mirrors.
Figure 19:
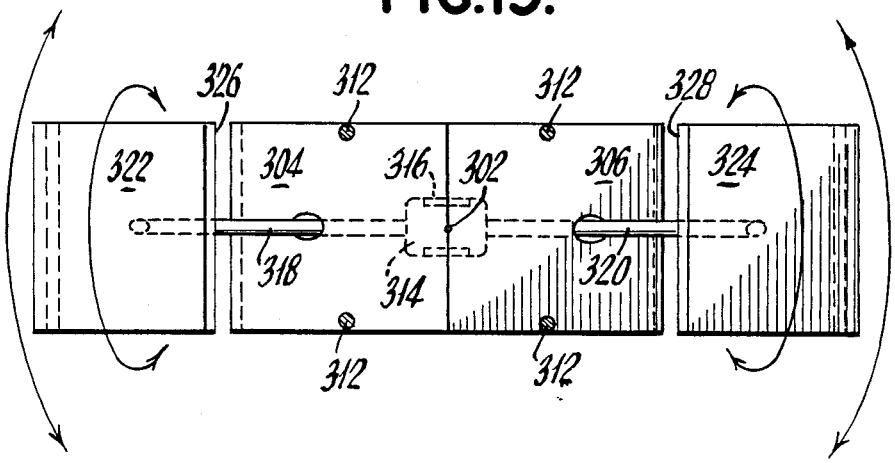
FIG. 19 is a view taken through the line 19—19 in FIG. 18.

FIGS. 18 and 19 illustrate another embodiment of the invention designated as light display system 280 which includes a stationary upper housing 282 having vertical side walls 284. Upper housing 282 is secured to a horizontal bar in the same manner as the upper housing 12 illustrated in FIG. 1. A single cross-plate 286 secured to side walls 284 of upper housing 12 has a hole through which a cylindrical mounting member 288 is positioned. Cylindrical mounting member 288 is rotatably connected to vertical side walls 284 by a plurality of bearings 290 which are positioned between the inner surface of vertical side walls 284 and cylindrical mounting member 288. A pan motor 292 is secured to the inner surface of one of the side walls 284 by a bracket 294. Motor 292 drives mounting member 288 by a gear 296 which meshes with an external circular gear 298 at the upper end of mounting member 288. Pan motor 292 is stationery and is connected to a source of electrical power by an external conductor 300 via a transformer and a controller (not shown). Mounting member 288 is rotated about a vertical axis of rotation 302.

A fixed reflector apparatus that is hung from mounting member 288 includes first and second central tilted mirrors 304 and 306, respectively, each mounted on first and second support plates 308 and 310, respectively. First and second central mirrors 304 and 306 with their support plates 308 and 310 are connected to rotatable mounting member 288 by four vertical support rods 312 secured to the bottom circular edge of mounting member 288 in a manner known in the art. First and second central mirrors 304 and 306 are centrally located and positioned at a 45° angle relative to axis of rotation 302 extending downwardly from axis of rotation 302

A tilt motor 314 is hung from the bottom of support plates 308 and 310 by a bracket 316 at axis of rotation 302. A pair of opposed, horizontally extending support-drive shafts 318 and 320 have ends connected to first and second radial support plates, 322 and 324, respectively, which support opposed first and second rotating, or radial tilt, mirrors 326 and 328, respectively. Shafts 318 and 320 simultaneously support and rotate opposed first and second radial tilt mirrors 326 and 328 by way of support plates 322 and 324. Shafts 318 and 320 extend through central support plates 308 and 310 and first and second central mirrors 304 and 306. Shafts 318 and 320 are supported at the areas of extension through support plates 308 and 310 by support bearings 329. First and second radial tilt mirrors 326 and 328 are both shown in a temporary position angled parallel to first and second central mirrors 304 and 306, respectively, that is, at 45° relative to axis of rotation 302 extending downwardly from axis of rotation 302. First and second radial mirrors are each continuously rotated over 360° by tilt motor 314 so that their orientation relative to first and second central mirrors 304 and 306 continuously changes. Radial mirrors 326 and 328 with their support plates 322 and 324 are shown in phantom line in FIG. 18 as indicated by positions 326A and 328A, respectively, and 322A and 324A, respectively, at positions 180° from the positions illustrated as parallel to first and second central mirrors 304 and 306.

Tilt motor 314, because it is being continuously rotated along with mounting member 288 by pan motor 292, is electrically connected to the source of electrical power by way of a slip-ring connector assembly 330 that is integral with cylindrical mounting member 288. Slip-ring connector assembly 330 includes a number of cylindrical electrical conductors 332, shown here as four for purposes of exposition and which are made of an electrically conductive material such as graphite and which are isolated from one another by cylindrical nonconductive insulators (not shown), that extend between the inner and outer surfaces of slip-ring connector assembly 330, which surfaces are integral, or continuous with, the inner and outer surfaces of cylindrical mounting member 330. Four outer connecting brushes (not shown) are held by a stationary inner brush holder 334 and electrically connected to slip-ring connector 330 at the inner surface of cylindrical mounting member 288 and are connected to tilt motor 314 by a stationary conductor 336. An outer brush holder 338 is electrically connected to slip-ring connector 330 at the outer surface of cylindrical mounting member 288. Inner brush member 334 transmits power from the source of electrical power via a transformer and a controller (neither shown) by way of an outer conductor 340. Tilt motor 314 is thus in continuous electrical contact with the power source even though it rotates along with its electrical contacts 334 and inner conductor 336. The direction of rotation of pan and tilt motors 292 and 314 can be programmed to be periodically reversed throughout the operational mode of the system.

A vertically hung, stationary luminaire 344 is mounted in upper housing 282. A typical luminaire 344 includes a lamp, an iris-pattern, a focus lens, and an optional color changer. The luminaire unit is operable by remote control. Light beams 346 and 348 are projected from luminaire 344 angled from axis of rotation 302 in a manner to be described below.

First and second central mirrors 304 and 306 receive light beams 346 and 348 from luminaire 344 via a cylindrical passage of mounting member 288. Beams 346 and 348 are directed at angles to first and second central mirrors 304 and 306, respectively, where they are received and directed to radial mirrors 326 and 328 as beams 346A and 348A, respectively, from where they are received and directed away from light display system 280 as beams 346B and 348B in the position illustrative positions shown in FIG. 18. Light beams 346B and 348B are moved in uninterrupted planar sweeps in accordance with the rotational movements of radial mirrors 326 and 328 as illustratively indicated by the 180° positions of mirrors 326A and 328A from which the light beams 346A and 348A are directed as upwardly directed light beams 346C and 348C, respectively, as shown in phantom line.

Figure 20:
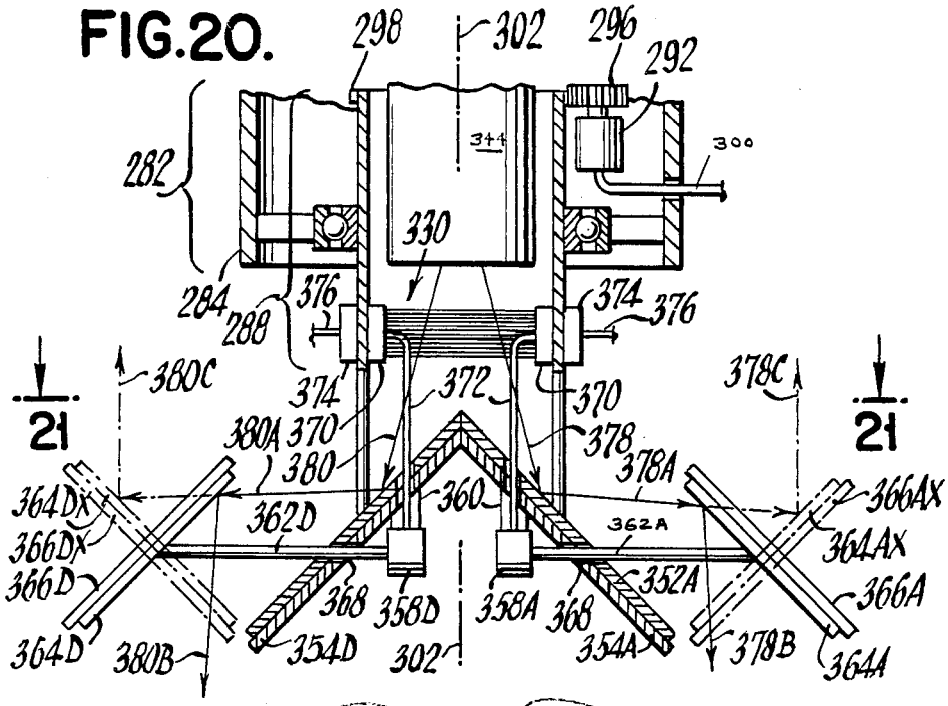
FIG. 20 is an elevational sectional view of another embodiment of the invention having a plurality of rotatable mirrors.
Figure 21:
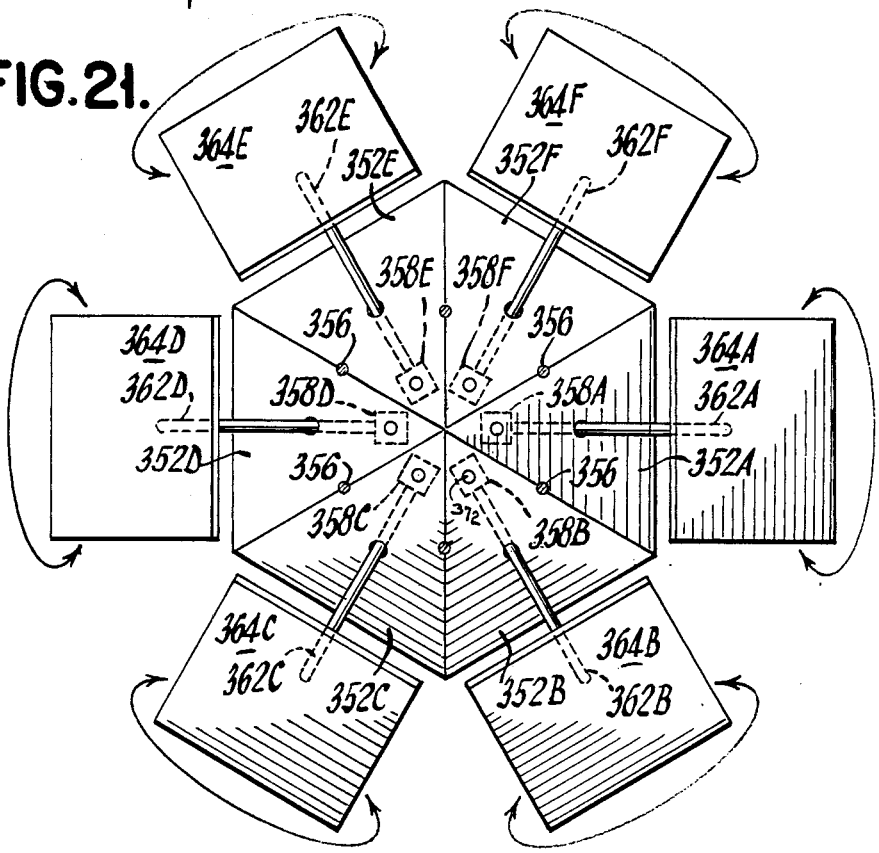
FIG. 21 is a view taken through the line 21—21 in FIG. 20.

FIGS. 20 and 21 illustrate another embodiment of the invention indicated as light display system 350, which includes a stationary upper housing 282 analogous to stationary upper housing 282 of the embodiment shown in FIG. 18. A single cross-plate 286 secured to side walls 284 of upper housing 12 has a hole through which a cylindrical mounting member 288 is positioned. Cylindrical mounting member 288 is rotatably connected to vertical side walls 284 by a plurality of bearings 290 which are positioned between the inner surface of vertical side wall 284 and cylindrical mounting member 288. A pan motor 292 is secured to the inner surface of one of the side walls 284 by a bracket 294. Motor 292 drives mounting member 288 by a gear 296 which meshes with an external circular gear 298 at the upper end of mounting member 288. Pan motor 292 is stationery and is connected to a source of electrical power by an external conductor 300 via a transformer and a controller (not shown). Mounting member 288 is rotated about a vertical axis of rotation 302.

A fixed reflector apparatus that is hung from mounting member 288 includes six central tilted mirrors 352A, 352B, 352C, 352D, 352E, and 352F, each mounted on support plates. Central mirrors 352A and 352D with their respective support plates 354A and 354D are illustrated in FIG. 21. Central mirrors 352A–F and their support plates are triangular in configuration and are joined at their apexes so as to form a sexagonal configuration for the fixed reflector apparatus. Central mirrors 352A–352F with their support plates are connected to rotatable mounting member 288 by six vertical support rods 356 secured to the bottom circular edge of mounting member 288 in a manner known in the art. Central mirrors 352A–F are connected at their apexes and positioned at a 45° angle relative to axis of rotation 302 extending downwardly from axis of rotation 302.

Six tilt motors 358A, 358B, 358C, 358D, 358E, and 358F are hung from the bottom of the support plates for central mirrors 352A–F by a brackets 360 shown typically for tilt motors 358A and 358D spaced from axis of rotation 302. Six horizontally extending support-drive shafts 362A, 362B, 362C, 362D, 362E, 362F, and 362E have ends connected to the support plates for six rotating, or radial, mirrors 364A–F, respectively.

Shafts 362A–F simultaneously support and rotate six radial mirrors 364A–F by way of their support plates typified by support plates 366A and 366D for radial mirrors 364A and 364D shown in FIG. 20. Shafts 362A–F extend through the central support plates for central mirrors 352A–F and are supported at their areas of extension through the support plates by support bearings 368. Radial tilt mirrors 364A and 364D are shown in a temporary position angled parallel to central mirrors 352A and 352D, respectively, that is, at 45° relative to axis of rotation 302 extending downwardly from axis of rotation 302, as typical of all radial tilt mirrors 364A–D. Radial mirrors 364A–F are each continuously rotated over 360° by their respective tilt motors 358A–F so that their orientation relative to first and second central mirrors 304 and 306 continuously changes. Radial mirrors 364A and 364D with their support plates 354A and 354D are shown in phantom line in FIG. 20 as indicated by positions 364A and 364D, respectively, and 364A and 364D, respectively, at positions 180° from the positions illustrated as parallel to central mirrors 352A and 352D. Although FIGS. 19 and 20 illustrate radial mirrors 364A–F as being at the same angles one to another, in fact, each tilt motor 358A–F is independent of the other tilt motors and is capable of rotating each respective radial mirror 364A–F at a different rotational speed than the other radial mirrors.

Tilt motors 358A–F, because they are being continuously rotated along with mounting member 288 by pan motor 292, are electrically connected to the source of electrical power by way of a slip-ring connector assembly 330 that is integral with cylindrical mounting member 288. Slip-ring connector assembly 330 has been previously described in regard to light display system 280.

Four outer connecting brushes (not shown) are each held by six separate inner brush holders 370 mounted and electrically connected to slip-ring connector assembly 330 at the inner surface of cylindrical mounting member 288 and are each connected to a respective one of tilt motors 358A–F by one of six inner conductors 372. Six stationary outer brush holders 374 are each electrically connected to slip-ring connector 330 at the outer surface of cylindrical mounting member 288. Inner brush members 334 transmits power from the source of electrical power via a transformer and a controller (neither shown) by way of six outer conductors 376. Tilt motors 358A–F are thus in continuous electrical contact with the power source even though they rotate along with their electrical contacts 370 and inner conductors 372. The direction of rotation of pan and tilt motors 292 and 358A–F can be programmed to be periodically reversed throughout the operational mode of the system.

A vertically hung, stationary luminaire 344 is mounted in upper housing 282. A typical luminaire 344 includes a lamp, an iris-pattern, a focus lens, and an optional color changer. The luminaire unit is operable by remote control. Light beams are projected from luminaire 344 angled from axis of rotation 302 in a manner to be described below.

Each of the central mirrors 352A–F receive light beams from luminaire 344 via a cylindrical passage of mounting member 288. The light beams are directed at angles to central mirrors 352A–F, where they are received and directed to their respective radial mirrors 364A–F from where they are received and directed away from light display system 350. The described reflecting process is illustrated in FIG. 20 for central mirrors 352A and 352D and their associated radial mirrors 364A and 364D, respectively, by way of example as representative of all six light beams. In particular, light beams 378 and 380 are projected by luminaire 344 to central mirrors 352A and 352D, respectively, from where the beams are reflected as light beams 378A and 380A, respectively, to radial mirrors 364A and 364D, respectively, from where the beams are reflected as light beams 378B and 380B, respectively, away from light display system 350. The light beams are reflected from each radial mirror in uninterrupted planar sweeps in accordance with the rotational movements of radial mirrors 364A and 364D, along with the other radial mirrors, as illustratively indicated by the 180° positions of mirrors 364A and 364D from which the light beams 378B and 380B are directed as upwardly directed light beams 364C and 364C, respectively, as shown in phantom line.

FIG. 22 illustrates an adjustable radial mirror, namely, mirror 366DX shown in FIGS. 20 and 21 for purposes of exposition. Shaft 360 in this embodiment has a hollow core in which is positioned a control rod 380 that is connected at one end to a pivot fitting 382 located on the opposite side of mirror mounting 366DX and connected at the other end to a worm 384 geared to a worm gear 386 connected to central mirror plate 354D. A handle 388 is connected to the end of control rod 380 for rotating worm 384. A stop 390 is connected to worm gear 386 in a manner known in the art. A support rod 392 is connected to pivot fitting 382 at one end and to a pivot pin 394 connected to a pivot mounting under the far end of mirror plate 366DX. When an operator rotates handle 388, worm 384 is activated to move control rod 380 either toward or away from radial mirror 364DX. When control rod 380 is moved toward radial mirror 364DX, pivot fitting 382 is pulled downwards so as to pull the far ends of radial mirror 364DX and mirror plate 366DX downwards to the position shown in phantom line as mirror plate 366DX' and mirror 364DX'. When control rod is moved away from radial mirror 364DX, radial mirror 364DX and mirror mounting 366DX are rotated in a direction opposite to the one shown in phantom line. When the angle selected for radial mirror 364DX is reached, stop 390 is operated to hold the worm and worm gear mechanism in place. An adjusting mechanism (not shown) allows mirror plate 366DX to tilt to the selected tilt angle relative to shaft 360D.

An alternate mechanism to the worm and gear mechanism described above is shown in FIG. 22A. A rack 396 connected to the inner end of control rod 380 is geared to pinion 398, which in turn in operated by a lever 400. An operator pulls or pushes control rod 380 by operation of lever 400 with the same results as described above for the worm and worm gear mechanism. A stop mechanism (not shown) as known in the art is operated when radial mirror 364DX is positioned at the angle desired.

An alternate embodiment for mounting radial tilt mirrors 362A–F of FIGS. 20 and 21 is illustrated in FIG. 23 with radial mirror 364D and its mirror plate 366D being exemplary of all radial mirrors 362A–F. A support-drive shaft 402A is connected to mirror plate 366D for radial mirror 364D. A cylindrical lower housing 406 includes a circular horizontal top wall 408 and a cylindrical vertical side wall 410, the latter being hung from the circular bottom edge of cylindrical mounting member 288. Motor 404 is connected to the inner surface of side wall 410. Mirror plate 354D with radial mirror 364D are rotated in the same manner as described for and illustrated in FIGS. 20 and 21. Lower housing 406 is preferably made of a translucent or transparent plastic material. A conductor 412 fixed to the inner surface of lower housing 406 electrically connects motor 404 with inner brush holder 334.

The embodiment of the invention particularly disclosed and described hereinabvve is presented merely as an example of the invention. Other embodiments, forms, and modifications of the invention coming within the proper scope and spirit of the appended claims will, or course, readily suggest themselves to those skilled in the art.

What is claimed is:

1. A light display system for projecting a double-pattern light display, comprising, in combination, a rotatably fixed first housing, a second housing connected to and rotatable relative to said first housing about a first axis, lamp assembly means fixedly mounted in said first housing for projecting at least two first light beams along said first axis, first reflector means fixedly mounted to said second housing for receiving said at least two first light beams and directing said at least two first light beams as at least two second light beams in a direction away from said first axis, first drive means connected to said first housing for rotating said second housing including said first reflector means about said first axis, second reflector means connected to said second housing and rotatable about a second axis transverse to said first axis, said second reflector means being for receiving said at least two second light beams from said fixed reflector means and for continuously directing said at least two second light beams as at least two third light beams generally about said second axis, second drive means connected to said second housing for rotating said rotatable reflector means about said second axis, said second housing having a cylindrical mounting member positioned between said lamp assembly means and said fixed reflector means, said mounting member having a cylindrical passage axially aligned with said first axis, said lamp assembly means directing said at least two first light beams through said cylindrical passage to said fixed reflector means, said second reflector means including at least two rotating mirrors, each rotating mirror of said at least two rotating mirrors receiving one said second light beam of said at least two second light beams from said first reflector means and reflecting said one second light beam in a direction about said second axis as a third light beam when said at least two rotating mirrors are rotated about said second axis, whereby only the second housing is rotated thus minimizing inertial forces.

2. The light display system according to claim 1, wherein said lamp assembly system is a luminaire containing a lamp, a lens, an iris, a shutter, optional color changers, and optional control devices.

3. The light display system according to claim 2, wherein said first reflector means includes at least two fixed mirrors connected to said second housing, each one of said at least two fixed mirrors receiving one of said first light beams and reflecting said one first light beam as a second light beam to one of said at least two rotating mirrors.

4. The light display system according to claim 3, wherein said at least two fixed mirrors includes a plurality of fixed mirrors and said at least two rotating mirrors includes a plurality of rotating mirrors, each one of said plurality of fixed mirrors receiving one of said first light beams and reflecting said one first light beam as a second light beam to one of said plurality of rotating mirrors, each one of said plurality of rotating mirrors receiving said second light beam and directing said second light beam as a third light beam in a direction about said second axis.

5. The light display system of claim 4, wherein each said fixed mirror of said plurality of said fixed mirrors is positioned at a first angle relative to said second axis.

6. The light display system of claim 5, wherein said first angle is approximately 45°.

7. The light display system of claim 5, wherein each said rotating mirror of said plurality of said rotating mirrors is positioned at a second angle relative to said second axis.

8. The light display system of claim 7, wherein each said second angle is approximately 45°.

9. The light display system according to claim 4, wherein each said rotating mirror of said plurality of said rotating mirrors projects said second light beam in a 360° rotational direction about said second axis.

10. The light display system according to claim 3, further including a slip-ring connector mounted with said cylindrical mounting member, said slip-ring connector having first and second electrical contact surfaces, said light display system further including a source of electrical power and first and second electrical connector means for electrically connecting said first and second drive means, respectively, to said source of electrical power, said second connector means including a first electrical conductor having first electrical contacts means connecting said second drive means with said first surface of said slip-ring connector and a second electrical conductor having second electrical contacts connecting said external surface of said slip-ring connector with said source of electrical power, whereby said second drive means rotates with said second housing about said first axis while keeping in electrical contact with said source of electrical power.

11. The light display system according to claim 10, wherein said slip-ring connector is a cylindrical slip-ring connector integral with said cylindrical mounting member.

12. The light display system according to claim 3, wherein said first drive means is a first electric motor positioned between and connected to one of said opposed plates of said first housing and gear and belt means connected to said first electric motor and said cylindrical mounting member, said gear and belt means being for rotating said cylindrical mounting member and said second housing upon activation of said first electric motor.

13. The light display system of claim 3, wherein said second drive means is at least two second electric motors, each second electric motor being connected to said second housing.

14. The light display system of claim 13, further including a shaft means generally aligned with said second axis and connected to said at least two electric motors and to said at least two rotating mirrors, said shaft means being for rotating said at least two rotating mirrors and for supporting said at least two rotating mirrors.

15. The light display system of claim 1, further including a mounting housing connected to said cylindrical mounting member, said second drive means being connected to said mounting housing.

16. The light display system of claim 14, further including adjusting means associated with said shaft means and with said at least two rotating mirrors, said adjusting means being for moving said at least two rotating mirrors to a selected tilt angle relative to said fixed mirrors.

* * * * *